US008534207B2

(12) United States Patent
Villiger

(10) Patent No.: US 8,534,207 B2
(45) Date of Patent: Sep. 17, 2013

(54) SECURITY CASSETTE, SECURITY CONTAINER, AND SECURITY SYSTEM

(76) Inventor: Peter Villiger, Beinwil (CH)

( * ) Notice: Subject to any disclaimer, the term of this patent is extended or adjusted under 35 U.S.C. 154(b) by 956 days.

(21) Appl. No.: 11/915,700

(22) PCT Filed: May 24, 2006

(86) PCT No.: PCT/EP2006/062570

§ 371 (c)(1),
(2), (4) Date: Mar. 10, 2011

(87) PCT Pub. No.: WO2006/125796

PCT Pub. Date: Nov. 30, 2006

(65) Prior Publication Data

US 2011/0155026 A1 Jun. 30, 2011

(30) Foreign Application Priority Data

May 27, 2005 (CH) ..... 907/05

(51) Int. Cl.
*E05G 1/06* (2006.01)

(52) U.S. Cl.
USPC ..... 109/57; 109/49; 70/48; 211/4; 312/350; 340/568.7

(58) Field of Classification Search
USPC ..... 70/78–82, 85–87; 109/45, 47, 49, 109/50, 52, 53, 56, 57; 312/107.5, 349–351; 211/4, 134; 340/568.1, 568.7
See application file for complete search history.

(56) References Cited

U.S. PATENT DOCUMENTS

| | | | | |
|---|---|---|---|---|
| 2,508,159 | A * | 5/1950 | Haas | 221/15 |
| 5,219,386 | A * | 6/1993 | Kletzmaier et al. | 70/277 |
| 5,504,325 | A * | 4/1996 | Talmon et al. | 250/222.1 |
| 6,191,690 | B1 * | 2/2001 | Mukogawa | 340/568.7 |
| 6,553,922 | B1 | 4/2003 | Lundblad et al. | |
| 7,028,621 | B2 * | 4/2006 | Mercier | 109/56 |
| 2004/0149817 | A1 | 8/2004 | Kuroiwa et al. | |
| 2006/0152339 | A1 * | 7/2006 | Mercier et al. | 340/5.73 |
| 2010/0218707 | A1 * | 9/2010 | Billet et al. | 109/53 |
| 2011/0056415 | A1 * | 3/2011 | Moog et al. | 109/45 |

FOREIGN PATENT DOCUMENTS

| | | | |
|---|---|---|---|
| EP | 0 692 599 | A | 1/1996 |
| EP | 1 069 540 | A | 1/2001 |
| WO | WO 00/08287 | A | 2/2000 |
| WO | WO 01/29786 | A | 4/2001 |

OTHER PUBLICATIONS

International Search Report for Int'l App. No. PCT/EP2006/062570 (claimed priority reference cited in U.S. Appl. No. 11/915,700), published Aug. 31, 2006.

* cited by examiner

*Primary Examiner* — Christopher Boswell
(74) *Attorney, Agent, or Firm* — McCarter & English, LLP

(57) ABSTRACT

The invention relates to a security box (100) for valuable objects (1) which can be received in a receiving element. Said security box comprises a protection device (110) for the valuable objects (1), which can be placed in different reinforcing modes according to different situations of the security box (100) and can be automatically released in at least one of the reinforcing modes, in order to devalue the valuable objects (1), and a receiving device (112) which is used to capture signals which influence parameters which respectively determine the necessary reinforcing mode. The receiving device comprises an optical capturing unit (112) which capture signals which are emitted by an optical emitter of the receiving element which contains the security box (100).

20 Claims, 2 Drawing Sheets

SECURITY CASSETTE, SECURITY CONTAINER, AND SECURITY SYSTEM

CROSS-REFERENCE TO RELATED APPLICATIONS

This application claims priority to PCT Application no. PCT/EP2006/062570, filed May 24, 2006, which claims priority to Swiss Application no. CH 00907/05, filed May 27, 2005, all of which are expressly incorporated by reference in their entireties as part of the present disclosure.

BACKGROUND OF THE INVENTION

The present invention relates to a security cassette for receiving valuables, a security container for receiving security cassettes, and a security system having multiple security containers and multiple security cassettes.

Security cassettes are used for receiving valuables, in particular paper money, on one hand during storage, for example, after filling in cash centers and during their use, for example, in ATM stations, and on the other hand during transport. The security cassettes typically have a trough-like container having an access opening, which is closable by a cover element or a flap. Special tools and/or measures must be used for closing and particularly for opening the access opening, which only authorized parties have. Security cassettes which are used in ATM stations additionally usually also have an outlet opening, which may be covered by a flap element (called a shutter).

Moreover, the security cassettes have a protection device. The protection device is used for making the theft of the security cassettes and the valuables located therein unattractive to a potential thief. This is performed in that the valuables are devalued as soon as the situation of the security cassette deviates in any way from the intended situation, the protection device also being able to be implemented to emit alarm signals.

The terms "situation" and "deviation from the intended situation" are to be understood in a broad meaning. For example, "situation" may refer not only to the physical location, but rather also the particular time and the particular threat situation. "Deviation" may particularly be understood to mean that location, time, and threat situation are other than intended. A "deviation" may arise, for example, through the attempt of an unauthorized to open the security cassettes, in particular in an improper way, or to remove them from a receptacle or subject them to certain mechanical strains or to transport them over a longer distance and/or for a longer time than intended.

The devaluation is typically performed in that a liquid suitable for this purpose, such as ink, is applied to the valuables by the protection device, by which the valuables are stained.

The protection device of the security cassette may be brought from a rest state into an armed state. In the rest state, the protection device may not be triggered. In the armed state, automatic triggering always occurs if the current situation of the security cassette, which may also be viewed as the actual situation, deviates from the intended situation or setpoint situation. To avoid undesired devaluing of the valuable objects, an armed protection device must be brought back into the rest state, if the security cassette is to be opened by authorized parties, for example.

The arming of the protection device is performed in accordance with the particular intended situation of the security cassette. In other words, the protection device of the security cassette may be brought into different arming modes depending on the type of instantaneous and/or imminent, i.e., planned situation of the security cassette. The goal in this case is to prevent unnecessary triggering of the protection device and simultaneously not to block required triggering of the protection device. For example, the protection device of a security cassette must react more sensitively to mechanical influences such as impact or movements if the security cassette is stationary at a location than if the security cassette is located on a transport. The intended situation and/or setpoint situation and/or parameters, which establish the corresponding arming mode of the protection device of the security cassette, are programmed into the protection device or are permanently predefined.

Security containers are used for the purpose of receiving the security cassettes during their storage and filling, their use in ATM stations, and their transport. The security containers generally have multiple receptacles implemented identically or differently, each of which may receive one security cassette. The receptacles on one hand and the security cassettes on the other hand have interacting locking means, using which the security cassettes may be locked in the receptacles. The security cassettes are not necessarily completely enclosed by the receptacles and/or security containers, but rather may only be docked therein, so that they are at least partially visible and/or directly operable from outside the security containers, for example, to remove them from the receptacles.

A typical sequence upon use of the security cassettes is as follows: The security cassettes are filled in a cash center. They are then brought using a transport vehicle to their usage location, for example, a bank and/or an ATM station. Before and after the transport in the transport vehicle, brief local restricted transports may be executed using a trolley. In the cash center, in the transport trolley, in the transport vehicles, and in ATM station, the security cassettes are each located in security containers therein. The security containers of the various locations may be different, but have to be implemented in such a way, of course, that even different receptacles may receive and lock the same type of security cassettes. The security containers and/or receptacles may have monitoring means, which react to unforeseen situations.

A security system comprises multiple security cassettes, multiple stationary and mobile security containers, and a monitoring system, to monitor the valuables and/or the security cassettes as permanently as possible.

The monitoring of the security cassettes is performed up to this point in a similar way to the monitoring of messages which are transported by courier firms, namely with the aid of manually operable PDA devices, which read identifications of the individual security cassettes and link them to associated information such as time and/or location. The selection and/or programming of the particular desired arming mode for the protective systems of the security cassettes is also performed with the aid of such PDA devices.

It is obvious that this typical type of monitoring and arming and/or programming of the security cassettes is demanding, time-consuming, susceptible to error, and able to be manipulated, in addition, the personnel who transport the security containers may be coerced by potential thieves because of the PDA devices.

It is an object of the present invention to overcome one or more of the above-described drawbacks and/or disadvantages of the prior art.

SUMMARY OF THE INVENTION

This object is achieved according to the present invention, for the security cassette for valuables being receivable in a receptacle, comprising a protection device for the valuables, which may be brought into different arming modes in accordance with different situations of the security cassette and may be triggered automatically in at least one of the arming modes, to thus devalue the valuables, and a receiver device, to receive signals which influence parameters which the particular required arming mode establishes, wherein the receiver device comprises an optical receiver unit, which is intended to receive signals, which are emitted by an optical transmitter of the receptacle containing the security cassette; for the security container comprising at least one receptacle for a security cassette, in which the security cassette is receivable in a lockable way, and which has a communication device, comprising one optical transmitter part per receptacle for emitting optical signals to the security cassette located in the receptacle, the security container transmitting at least one parameter, which is capable of transferring the security cassette into a predetermined mode, using the optical signals of the security cassette located in the receptacle; and a security system, comprising multiple security containers, multiple security cassettes, a communication system which has a transmitter system for emitting signals at least to the security containers and a receiver system for receiving signals at least from the central transmitters of the security containers, and a computer system for processing received signals and/or for providing signals to be emitted on the basis of available data.

Advantageous refinements of the present invention are described by the particular dependent claims.

Such security cassettes are fundamentally known, for example, from Swiss Patent Application CH-01 532/04 of 17 Sep. 2004. The novel security cassette differs from the typical security cassettes in particular in that no additional PDA device and practically no manually executable control activities, in particular no such activities in unprotected environments are necessary for its monitoring and for arming, i.e., for programming the particular desired arming mode.

The signal transmission occurs directly, namely optically and autonomously, between the security cassettes and the security containers and/or receptacles and, for example, wirelessly (over the airwaves) between a central office of the security system and the security containers. Within the security containers, i.e., between a communication central office of the security containers and the individual receptacles, a line-bound signal transfer is preferably provided.

The entire transport and monitoring procedure is thus significantly simplified and the security is increased, the monitoring may be performed continuously, the situation of every security cassette preferably being known at all times in a central office of the security system. Error sources and dangers of coercion are precluded or extensively reduced.

The novel security cassettes have receiver devices, which are formed by optical receiver units or have optical receiver units. Optical signal transmission is free of potential and may not or may hardly be interfered with by external means. Every optical receiver unit is designed for receiving signals which are emitted by the particular receptacle equipped with the security cassette using an optical transmitter. If it is intended that security cassettes be housed in differently implemented receptacles, whose transmitters are implemented and/or situated differently, the security cassettes also correspondingly have differing or differently operable optical receiver units.

The protection devices of the security cassettes have a sensor system which is designed to detect parameters of the particular situation of the security cassettes and cause the triggering of the protection device in accordance with the arming mode, if the actual situation of the security cassette deviates from its setpoint situation.

This sensor system typically has multiple sensors for sensing various properties. Depending on the task which the sensors have to fulfill, they are deactivated in accordance with the arming modes.

The security cassettes preferably also have transmitter device, for emitting signals which contain information about the security cassette and/or its situation. The transmitter device preferably has an optical transmitter unit, to emit signals to the receptacle in which the security cassette is received. The transmitter device may also have further transmitter units, in particular to emit signals directly to a communication system of a security system, the security cassettes forming a part of the security system, or to emit signals to a system-external location.

The security cassette is typically formed by a trough-like container, having an access opening or filling opening, which is closable by a cover element. Security cassettes which are employed for use in security containers such as ATM devices in an ATM station additionally have an outlet opening, which may be covered by a flap element (shutter) or a slide element. The outlet opening is preferably situated distal from means for devaluing the valuables.

The novel security container has at least one, but usually multiple receptacles, in which one of the security cassettes may be received, usually in a lockable way. The security container has a communication device having a transmitter device and a receiver device. The transmitter device comprises one transmitter part per receptacle, for emitting optical signals to the security cassette located in the receptacle. The receiver device comprises a central receiver for receiving signals of a communication system of a security system, of which the security container forms an element. Furthermore, internal connections are provided between the central receiver and the transmitter parts to transfer internal container signals.

The receiver device of the communication device of the security container preferably also has one, typically optical receiver part per receptacle, for receiving signals of the security cassette located in the receptacle. The transmitter device of the communication device of the security container preferably also has a central transmitter for emitting signals, in particular to the communication system of the security system, connections being provided between the central transmitter and the receiver parts to transfer internal container signals.

The security container may have an input device for influencing the arming modes of the protection devices of the security cassettes received in the security container.

The security container may, for example, be implemented as a container for stationary use and be situated in a cash center or an ATM station, for example.

The security container may also be implemented as a container for transports and be situated in a trolley or motorized transporter, for example.

The novel security system comprises multiple security containers and multiple security cassettes. Furthermore, the security system has a communication system, which has at least one transmitter system for emitting signals to the security containers and preferably a receiver system for receiving signals from the security containers. In addition, the security system has a computer system, in particular for processing received signals and/or for providing signals to be emitted on the basis of available data. The computer system has an input unit, for the overall monitoring and/or control of the procedures in connection with the use of the security cassettes and the security containers, both the intended situations and also the unintended situations of the security cassettes being taken into consideration.

The communication system of the security system is preferably also implemented for exchanging signals with a system-external location, in particular with a bank and/or police location.

Furthermore, the communication system of the security system may also be implemented for direct exchange of signals with security cassettes located in security containers.

In the simplest embodiment of the elements of the present invention described up to this point, only one information flow and/or one signal transfer is possible, which either runs from the central office of the security system to the security containers and/or receptacles and further from the receptacles to the individual security cassettes, or which runs from a security container to the individual security cassettes.

Using signals which go from the security containers and/or receptacles to the individual security cassettes, the arming modes of the security cassettes may be established, as already noted, in that the optical transmitter parts of the receptacles emit appropriate signals to the receiver units of the security cassettes as soon as the security cassettes are docked in the receptacles or arrive in their proximity. Depending on the receptacle and possibly depending on the situation, the suitable arming mode is thus selected.

Using signals which go from the central office of the security system to the security containers and/or receptacles, it is possible to control which arming modes of the security cassettes are to be established when security cassettes are docked.

For bidirectional communication, the security cassettes must also contain, in addition to the optical receiver units, transmitter units, such as optical transmitter units, to emit signals to the receptors and/or the security containers. The receptors must also not only contain transmitter parts for transmitting the signals to the security cassettes, but rather also receiver parts for receiving the signals of the security cassettes. In addition, the security containers must have central transmitters for emitting signals to the communication system of the security system. The receiver system of the communication system of the security system must in turn be implemented for receiving signals of the security containers.

The security cassettes may also have multiple receiver units, in particular if they are alternately docked in different receptacles having differently situated transmitter parts.

It may occur that valuables are devalued erroneously and/or prematurely. Therefore, measures are preferably taken which prevent the output of such devalued valuables from security cassettes, which are located in ATM stations, in any case.

Other objects and advantages of the present invention will become readily apparent in view of the following detailed description of currently preferred embodiments and accompanying drawings.

BRIEF DESCRIPTION OF THE DRAWINGS

Further details of the present invention are described in the following on the basis of exemplary embodiments and with reference to the drawings.

Constructive elements are shown by solid lines, signals or signal lines are shown by dashed lines.

DETAILED DESCRIPTION OF THE CURRENTLY PREFERRED EMBODIMENTS

Figure 1:
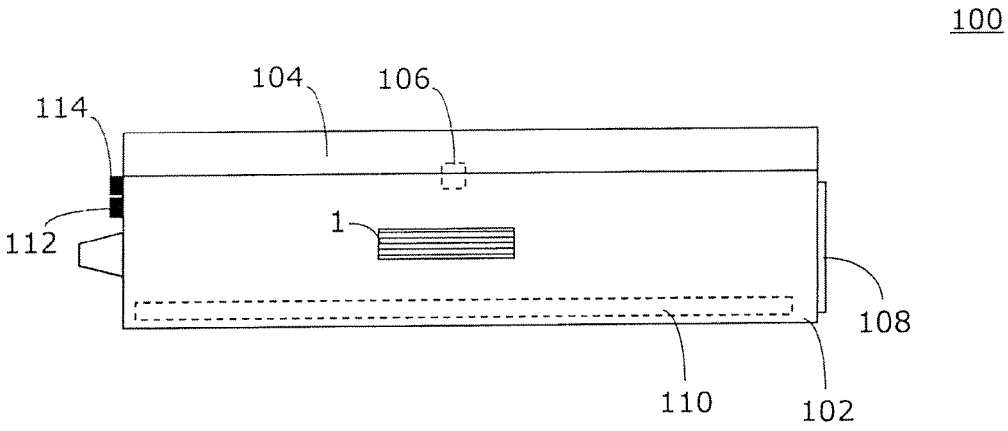
FIG. 1 shows a security cassette according to the present invention in a simplified illustration.

FIG. 1 shows a security cassette 100. The security cassette 100 has a type of trough part 102 for receiving valuables 1 and a cover element 104 for closing an access or filling opening of the trough part 102. The cover part 104 is locked removably on the trough part 102. Instead of a cover 104, a flap, a slide, a door, or other means may also be used. A sensor 106 is provided, which establishes the locking. The cover part 104 may only be unlocked using a specific tool and/or a specific code to be input. Security cassettes 100 which are provided for use in an ATM station also have a, usually slot-like outlet opening, which may typically be closed or covered using a pivotable or displaceable flap part 108 (shutter). Moreover, the security cassette 100 has a protection device 110, which is used for protecting the valuables 1. The protection device 110 has a device for devaluing the valuables 1. The protection device 110 comprises an ink module, for example, whose construction and mode of operation is known. The ink module of the protection device 110 and the outlet opening having the flap part 108 are attached as far as possible from one another, for example, on diametrically opposite faces of the security cassette 100.

The protection device 110 may be in a rest state, in which it is not armed and is therefore not triggerable automatically. The valuables 1 in the security cassette 100 are then only protected in that the cover part 104 of the security cassette 100 may not be opened without the code and/or the appropriate instrument and the flap part 108 also closes the outlet opening in a secure way. Therefore, there is no automatic devaluation of the valuables 1, independently of what occurs with the security cassette 100.

The protection device 110 may be aimed, and when it is in the armed state, it is automatically triggered as soon as the effective situation of the security cassette 100 deviates from its intended or predefined situation. Upon the arming of the protection device 110, the security cassette 100 may be brought into differing or differently sensitive arming modes depending on the intended threat state, in that certain parameters, which define these arming modes, are established differently. Triggering the protection device 110 has the result that the valuables 1 are devalued by the ink of the ink module. The valuables 1 may then not be delivered through the outlet opening 108 in any case, to prevent this and further elements (such as an ATM machine), which come into contact or will come into contact with them directly or indirectly, from being contaminated. In this way, inter alia, further valuables from other security cassettes are to be prevented from being unintentionally devalued by contact with components contacting multiple security cassettes (such as a dispenser in an ATM machine).

The security cassette 100 has a receiver device, which comprises an optical receiver unit 112. The optical receiver unit 112 is implemented to receive optical signals which are emitted by a receptacle 210 shown in FIG. 2. The signals thus received essentially have the result that the protection device 110 is brought into the particular required arming mode. Furthermore, the security cassette 100 has a transmitter device, which preferably comprises an optical transmitter unit 114.

The security cassette 100 has manifold sensors to be able to establish undesired actions and/or unforeseen changes of its situation independently at any time and to arm the protection device 110 appropriately. In particular, the following sensors may be provided: the above-mentioned sensor 106 for establishing whether the cover element closes the access opening, in impact sensor, a position sensor, a timer for establishing a maximum transport time, and an absolutely or relatively operating temperature sensor. In addition, it may be established with which tolerances and/or time delays the protection devices 110 of the security cassettes 100 are to be triggered after the sensors have delivered their signals.

These sensors are typical devices and are known to those skilled in the art.

The individual sensors may be activated or deactivated depending on the selected arming mode. The following list contains examples of two arming modes, namely for a high-sensitivity ATM arming mode and for a relatively less sensitive transport mode, and parameters, according to which the sensors are to be activated and/or deactivated. In addition, a service mode is provided for opening the security cassettes without activating the protection device.

| | Arming mode "ATM" | Arming mode "transport" |
|---|---|---|
| Impact sensor/ triggering after (ms) | Maximum 1 impact total 0 | Maximum 2 impacts total after 2 impacts in 10 seconds |
| Position sensor | Activated | Deactivated |
| Timer | Activated | Deactivated or sidewalk time predefined |
| Switch cover element | Activated | Activated |
| Temperature sensor (ΔT/time) | Activated | Deactivated |

All sensors listed are not necessarily provided, but further sensors may also be provided if necessary. The individual parameters may also be selected or set differently than specified above. Changeable parameters may also be predefined.

Figure 2:
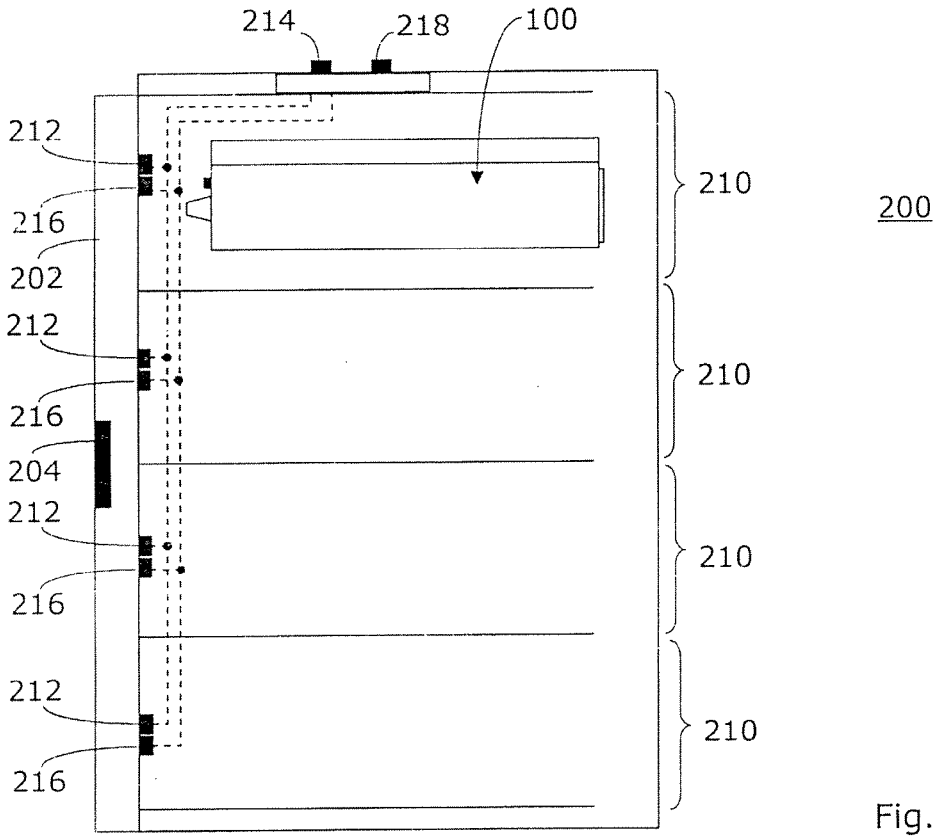
FIG. 2 shows a security container according to the present invention in a simplified illustration.

FIG. 2 shows a security container 200, which is implemented as an ATM. The security container 200 is, in a way which is not illustrated, installed and/or fastened like a safe in an ATM station. The security container 200 has a lock 202, such as a safe lock and/or a code lock and/or a numeric lock, and the security cassettes 100 may only be removed from the security container 200 in the event of correct, i.e., authorized actuation of this lock 202. If a code lock or numeric lock is used as the lock 202, as shown, it has an input unit 204, for example, in the form of a selection dial or a keyboard or a touchscreen.

The security container 200 has at least one and usually multiple, frequently four receptacles. Each receptacle 210 may receive one security cassette 100. According to FIG. 1, the security cassettes 100 which the receptacles may receive contain valuables 1, in the form of banknotes in the present exemplary embodiment, each security cassette 100 containing notes of identical denomination or note combinations having specific total values, for example.

Figure 3:
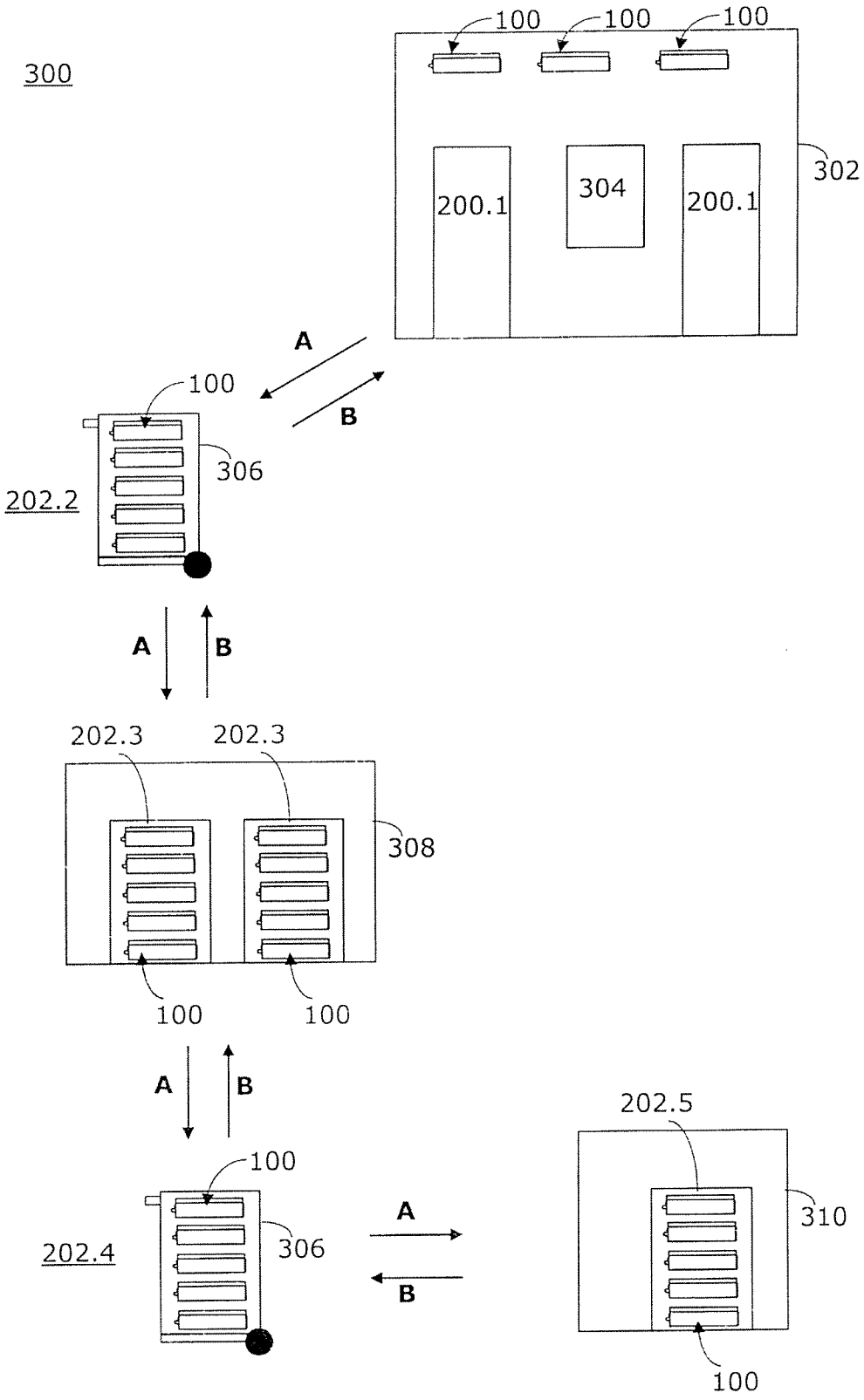
FIG. 3 shows a security system according to the present invention in a simplified, schematic illustration.

The security containers 200 have a communication device, namely at least one optical transmitter part 212 per receptacle 210, for emitting signals to the receiver units 112 of the security cassettes 100, and a central receiver 214 for receiving signals which are emitted by a transmitter system of a central office of a security system, as shown in FIG. 3.

The protection devices 110 of the security cassettes 100 are brought into the suitable arming mode using the signals emitted by the optical transmitter part 212 of the receptacle 210. The input unit 204 may also be connected directly or indirectly to the optical transmitter parts 212 of the receptacles 210.

If the security cassettes 100 are not to be removed from the security container 200, the protection devices 110 of the security cassettes 100 are in a very sensitive arming mode. The slightest unintended action has the result that the protection devices 110 are triggered. If the security cassettes 100 are to be removed from the security container 200, the protection devices 110 of the security cassettes 100 are previously brought into a less sensitive arming mode, which is tailored to the actions to be expected during transport, with the aid of the input unit 204.

Furthermore, the security containers 200 have one receiver part 216 per receptacle 210 and a central transmitter 218. The elements 214, 218 are optional. The security containers 200 may also be operated autonomously, i.e., without connection to another system or a computer.

Although efforts are made to situate and anchor security containers 200 in the form of ATM devices in ATM stations in such a way that unauthorized parties will actually not wish to remove the entire security container 200 from its anchoring, it happens again and again. The removal of an anchor security container 200 per se therefore has the result according to the present invention that signals are emitted which indicate this removal, independently of the triggering of the protection devices 110 of the security cassettes 100, in particular even if these protection devices 110 are not armed as intended for any reason. Every security container 200 may also be provided with a sensor system for this purpose, in principle identical to those of the individual security cassettes.

FIG. 3 shows the entire security system 300, and it is also described in the following on the basis of FIG. 3 how this security system 300 is used. The individual security cassettes 100 are filled with valuables 1, in the present case with banknotes, and sealed in a cash center 302. The filling is registered and stored for this purpose in a computer system 304 for every individual security cassette 100, generally together with data which describes the intended situations such as the destination and the intended transport time and possibly the intended transport distance. In the cash center 302, the filled security cassettes 100 are stored in the receptacles 210 of a first, stationary security container 200.1. They are reloaded as needed into a second security container 200.2. This second security container 200.2 is movable and/or implemented as a trolley 306. The security container 200.2 is brought to a transport vehicle 308, and the filled security cassettes 100 are reloaded from the second security container 200.2 into a third security container 200.3, the latter typically being permanently installed in the transport vehicle 308. The filled security cassettes 100 reach their destination using the transport vehicle 308, i.e., in the surroundings of an ATM station 310. The filled security cassettes 100 are reloaded here into a further security container 200.4, again in the form of a trolley 306, and brought directly to the ATM station 310. Finally, the filled security cassettes 100 are introduced into a fifth security container 200.5 and/or into the ATM device 200.5. These procedures are illustrated by arrows A.

In the course of time, the security cassettes 100 are emptied, in that bank customers receive banknotes through the outlet openings of the security cassettes 100.

The return transport of the entirely or partially emptied security cassettes 100 occurs in the reverse way in the direction of the arrows B.

It is not necessary to supply all security cassettes 100 to the same ATM device, nor do all security cassettes 100 of an ATM device have to be empty and thus ready for return transport into the cash center 302 simultaneously.

Each security container 200.1, 200.2, 200.3, 200.4, 200.5, or more precisely each receptacle 210, transmits signals to the security cassettes 100, using which the particular arming mode of the protection device 110 of the security cassettes 100 is established.

If the security cassettes 100 are deposited in the ATM station 310, the protective systems 110 of the security cassettes 100 may additionally be brought into an ATM arming mode, which is highly sensitive, with the aid of the keyboard or input unit 204.

However, in another embodiment, the security cassettes 100 may also be brought automatically into an ATM arming mode in ATM station 310, in that the ATM station 310 communicates optically to the security cassettes 100 that they are now located in the ATM environment. The security cassettes 100 then change into the ATM arming mode.

Upon the removal of the security cassettes from the ATM station 310, a data/key input must first be actuated with the aid of the input unit 204, to switch the security cassettes 100 into a less sensitive arming mode, i.e., into a transport mode, because otherwise the protection devices 110 would be triggered as soon as the security cassettes 100 were manipulated.

Further signals may be delivered as needed from the cash center 302 to one or more of the security containers 200 and from there if necessary via the individual receptacles 210 to the security cassettes 100 located in the receptacles 210.

However, signals may also flow in the reverse direction. In particular, in this way the effective situation of the security cassettes 100 may be established at any time in a central office of the security system 300 and/or in the cash center 302 like a watchdog system. The security cassettes 100 may thus be located at any time, or one may reconstruct subsequently what has happened on the basis of recorded information. In addition, individual or all protection devices 110 may be triggered from the cash center 302. Finally, individual or all security cassettes 100 in the ATM station may be blocked and/or prevented from delivering banknotes, to prevent the contamination of a dispenser after one of the protection devices 110 has triggered, for example.

In addition, a device may be provided in the transport vehicle 308 outside the security container 200, which allows an accompanying person to trigger an alarm and/or to trigger the protection devices 110 of the security cassettes 100 in the event of problems. This may be performed on the basis of independent findings of the personnel or on the basis of received signals or separate mobile telephone communications, for example, in particular of the cash center 302. Furthermore, the transport vehicle 308 may have a display on which interference and problems, but also incoming signals, are displayable.

The triggering of the protection devices 110 may, as in the transport vehicle 308, also be triggered externally and/or by third parties when the security cassettes 100 are located in ATM station 310.

In general, only encrypted communications are transmitted by the signals, which in turn increases the security standard. In this way, the optical communication is not understandable, if anyone is capable of listening in on it. In addition, it is not possible to influence or change the communication if one does not have the key necessary for the encryption.

What is claimed is:

1. A security cassette for valuables, the security cassette being removably receivable in a receptacle, comprising:

a protection device for the valuables, which may be brought into different arming modes in accordance with different situations of the security cassette and may be triggered automatically in at least one of the arming modes, to thus devalue the valuables, and a receiver device, to receive signals which influence parameters which define the respective required arming mode, wherein the receiver device comprises an optical receiver unit, which is intended to receive signals, which are emitted by an optical transmitter of the receptacle containing the security cassette.

2. The security cassette according to claim 1, wherein the protection device of the security cassette has a sensor system, which is designed for the purpose of detecting parameters of the situation of the security cassette and causing the triggering of the protection device in accordance with the arming mode.

3. The security cassette according to claim 2, wherein the sensor system of the protection device of the security cassette has multiple sensors, at least one of which is deactivatable in accordance with the arming modes.

4. The security cassette according to claim 1, wherein the security cassette further comprises a transmitter device for emitting signals having information about the situation of the security cassette.

5. The security cassette according to claim 4, wherein the transmitter device of the security cassette comprises an optical transmitter unit for emitting signals to an optical receiver part of the receptacle in which the security cassette is located.

6. The security cassette according to claim 4, wherein the transmitter device of the security cassette comprises a direct transmitter unit for emitting signals.

7. The security cassette according to claim 6, wherein the direct transmitter unit is for emitting signals to a receiver system of a security system.

8. The security cassette according to claim 1, further comprising:

a trough part, having an access opening, which is closable by a cover part, slide, door, cover, or flap, and an outlet opening, situated distally from means for devaluing the valuables.

9. The security cassette according to claim 8, wherein the outlet opening is covered by a flap part.

10. A security container comprising:

at least one receptacle for a security cassette, in which the security cassette is removably receivable in a lockable way, and a communication device, comprising one optical transmitter part per receptacle for emitting optical signals to the security cassette located in the receptacle, the security container transmitting at least one parameter, which is capable of transferring the security cassette into a predetermined mode, using optical signals transmitted to the security cassette located in the receptacle.

11. The security container according to claim 10, wherein the security container is provided with a central receiver for receiving external signals, and has a connection between the central receiver and the transmitter parts of the receptacles to transfer signals.

12. The security container according to claim 10, wherein the communication device comprises at least one optical receiver part per receptacle, for receiving signals of the security cassette located in the particular receptacle, and a central transmitter for emitting signals, with connections being provided between the receiver part and the central transmitter to transfer signals.

13. The security cassette according to claim 12, wherein the central transmitter is for emitting signals to a receiver system of a security system.

14. The security container according to claim 10, further comprising an input device, for directly or indirectly influencing arming modes of a protection device of the security cassette received in the security container.

15. The security container according to claim 10, wherein the security container is implemented as a container for stationary use and for employment in a cash center or an ATM station.

16. The security container according to claim 10, wherein the security container is implemented as a container for transports and for employment in a trolley or motorized transporter.

17. A security system, comprising:

multiple security containers, each comprising at least one receptacle for a security cassette, in which the security cassette is receivable in a lockable way, and a communication device comprising one optical transmitter per receptacle for emitting optical signals to a security cassette located in the receptacle, the security container transmitting at least one parameter, which is capable of transferring the security cassette into a predetermined arming mode, using optical signals transmitted to the security cassette located in the receptacle;

multiple security cassettes, each cassette receivable in the at least one receptacle, and each cassette comprising a protection device for valuables, which may be brought into different arming modes in accordance with different situations of the security cassette and may be triggered automatically in at least one of the arming modes, to thus devalue the valuables, and a receiver device, to receive signals which influence parameters which the particular required arming mode establishes, wherein the receiver device comprises an optical receiver unit, which is intended to receive signals, which are emitted by the optical transmitter of the communication device for the receptacle containing the security cassette;

a communication system which has a transmitter system for emitting signals at least to the security containers, and a receiver system for receiving signals at least from the central transmitters of the security containers; and a computer system for at least one of (i) processing received signals and (ii) providing signals to be emitted on the basis of available data.

18. The security system according to claim 17, wherein the communication system is implemented for exchanging signals with a system-external location.

19. The security system according to claim 18, wherein the system-external location is a bank and/or police location.

20. The security system according to claim 17, wherein the communication system is also implemented for direct unidirectional or bidirectional transfer of signals with security cassettes located in the receptacles of the security containers.

* * * * *